United States Patent [19]

Price

[11] 4,449,846

[45] May 22, 1984

[54] TRANSVERSE SADDLE TYPE BOAT CRADLE

[76] Inventor: James W. Price, Rte. 1 Box 87, Grifton, N.C. 28530

[21] Appl. No.: 370,838

[22] Filed: Apr. 22, 1982

[51] Int. Cl.[3] ..... B63C 5/05

[52] U.S. Cl. ..... 405/7

[58] Field of Search ..... 405/1-7; 114/44, 45, 344; 414/350

[56] References Cited

U.S. PATENT DOCUMENTS

| | | | |
|---|---|---|---|
| 3,119,127 | 1/1964 | Taggert | 114/344 |
| 3,177,668 | 4/1965 | Schneider et al. | 405/3 |
| 3,224,019 | 12/1965 | Gudmundson | 114/45 |
| 3,260,377 | 7/1966 | Vilter | 405/3 |
| 3,554,394 | 1/1971 | Hedman | 414/350 |
| 4,022,027 | 5/1977 | Tetzner | 405/3 |
| 4,318,632 | 3/1982 | Fortmeyer | 405/3 |

*Primary Examiner*—David H. Corbin

*Attorney, Agent, or Firm*—Mills & Coats

[57] ABSTRACT

The present invention relates to a transverse saddle type boat cradle for transversely supporting a boat at fore-and-aft positions. A rectangular base frame structure is provided with a vertical support frame assembly at each end. Each vertical support frame assembly is adapted to assume an upright supporting position. A detachable hull support panel is secured transversely within each vertical support frame assembly. To provide direct engagement and support for the boat, the hull support panel includes an upper support surface or edge that is selectively shaped and configured to generally conform to the shape of a particular boat hull. Thus in a supported position, a hull support panel underlies and engages the supported boat at fore-and-aft positions. Further to stabilize the boat and prevent rotation of the same within the hull support panels, there is provided a keel restraining device that is operative to prevent the keel from moving laterally.

9 Claims, 2 Drawing Figures

TRANSVERSE SADDLE TYPE BOAT CRADLE

FIELD OF INVENTION

The present invention relates to boats and support system for supporting boats and particularly sailboats out of the water, and more particularly to a transverse cradle type support system that is particularly adapted and designed to accommodate and support boat hulls of various sizes and shapes.

BACKGROUND OF INVENTION

The review of the prior art and commercially available boat support systems will reveal that cradle type boat support systems are known and appreciated today. An appreciation of the state of the art in this area can be found from a review of the disclosures of the following United States Patents that relate to boat support systems in general: U.S. Pat. Nos. 3,131,902; 3,139,277; 3,554,394; 3,586,285; 4,094,527 and 4,155,667.

While boat support systems are commercially available today, they are not without their disadvantages. Principally among the disadvantages of commercially available boat support systems today is that they are generally limited in the type and size of boat that they will accommodate. Often boat support systems purchased today are only designed to support one size of boat. Furthermore the restriction goes on a step further inasmuch as the same will often only support a certain shape boat of that size. As a result boat manufacturers and dealers and other firms that utilize boat support systems in their business have found it frustrating in attempting to purchase boat support systems that are practical and to a significant extent universally compatible with a wide range of boat sizes and shapes.

In addition some commercially available boat support systems known today tend to be unduly complicated, and difficult to handle as well as being relatively expensive. Often one finds that because of a particular design approach that the size of individual components are required to be larger than necessary if the boat support system had been designed more appropriately. Obviously this adds weight and accordingly cost not to mention the added difficulties and effort required in handling and moving.

Therefore, there exists a real need for a boat support system, especially for sailboats, that is designed to easily and conveniently accommodate different size and shaped hulls and which is relatively simple and inexpensive. Further it is important that such a boat support system be designed such that it can assume a compact size and position for convenient and easy handling, storage and transport.

SUMMARY OF INVENTION

The present invention entails a transverse saddle type boat support system especially designed for sailboats, but which could be used for other types of boats as well, which overcomes the disadvantages and drawbacks of boat support systems of the prior art. In particular the present boat support system is designed to accommodate boats having hulls of various sizes and shapes. More particularly the boat support system of the present invention has a wide variety of uses. For example, the boat support system of the present invention can be utilized for supporting a boat during manufacturing or used for supporting the boat during shipping, or used to store a boat on, and finally can even be sold with the boat such that the owner will always have a dry storage system available.

In addition the boat support system of the present invention is designed such that the principal upstanding structure can be moved to a folded or transport position where the same lies closely adjacent the base frame structure of the boat support system. This essentially reduces the space occupied by the boat support system of the present invention to the area occupied by a generally flat rectangular base structure. Obviously this greatly facilitates the shipping and/or storage of quantities of the boat support system.

Briefly, from a structural point of view, the boat support system of the present invention includes a generally rectangular steel frame with a vertical support frame assembly mounted on each end. Each vertical support frame assembly includes a detachable hull support panel that generally extends transversely across the base frame structure. The hull support panels are provided with a selectively shaped and curved upper edge that is generally arcuate, which directly engages and supports the hull of the boat being supported. Because of the positions of the vertical support frame assemblies, this means that the boat is supported at fore-and-aft positions by the saddle type hull supports.

To stabilize the boat in a supported position, there is provided a keel restraining assembly that essentially comprises a pair of laterally spaced apart panels that define an opening therebetween for receiving the keel. The presence of the panels prevents the keel from moving laterally, thereby essentially stabilizing the boat in a supported position.

It is, therefore, an object of the present invention to provide a practical and reliable boat support system that will accommodate a wide range of hull shapes and sizes.

Another object of the present invention resides in the provision of a cradle type boat support system especially designed for sailboats which can be used for other types of boats as well, which utilizes a transverse type saddle support structure disposed at fore-and-aft locations underneath the hull of the boat being supported.

It is also an object of the present invention to provide a transverse saddle type boat support system of the character referred to above that is relatively simple in design, and which is particularly designed to minimize the size of respective components of the system, and which is relatively simple and inexpensive.

It is also an object of the present invention to provide a transverse saddle type boat support system of the character referred to above that is designed such that substantially all of the normal upstanding support structure can be easily and conveniently moved to a transport and/or storage position where the same lies adjacent the main or base frame structure of the support system so as to substantially reduce the effective height of the boat support system for transport.

A further object of the present invention is to provide a cradle type boat support system that is especially designed to be used by manufacturers, individuals or firms that ship and transport boats, and other firms and businesses which require the use of boat support systems in their everyday business.

Other objects and advantages of the present invention will become apparent from a study of the following description and the accompanying drawings which are merely illustrative of the present invention.

TRANSVERSE SADDLE TYPE BOAT SUPPORT SYSTEM

Figure 1:
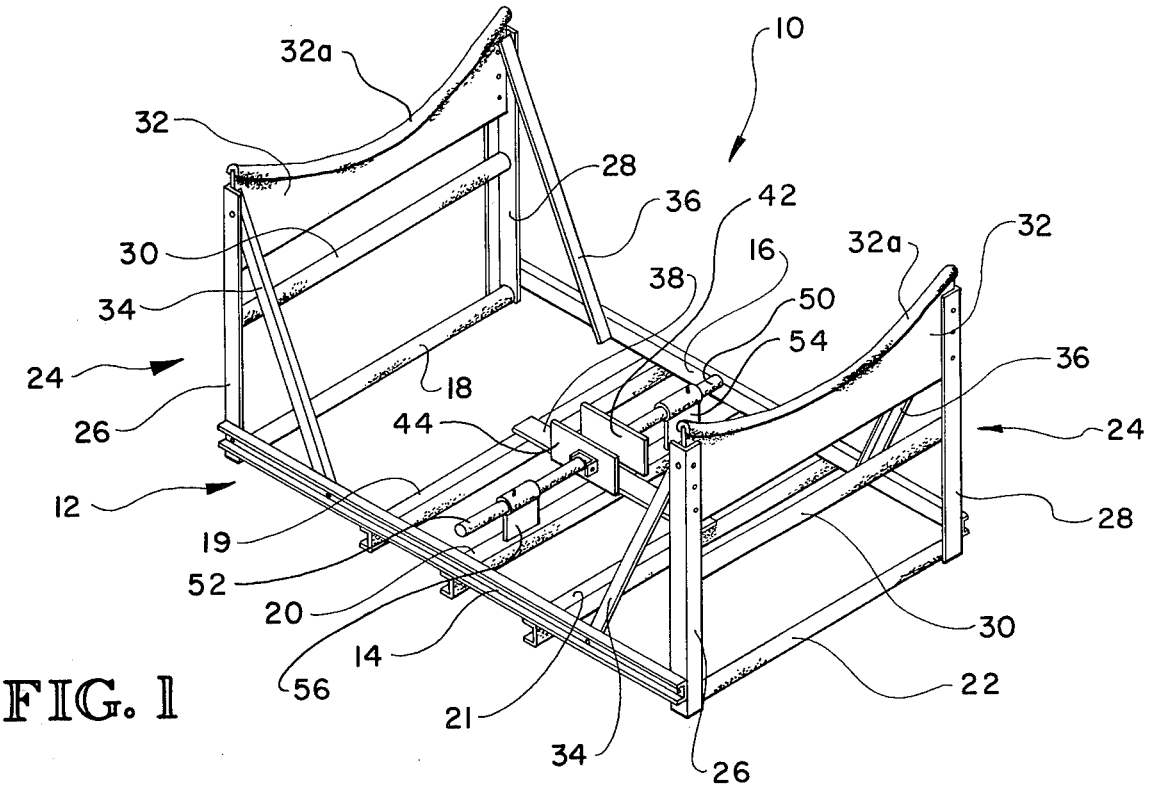
FIG. 1 is a perspective view of the transverse saddle type boat support system of the present invention.

With further reference to the drawings, the transverse saddle type boat support system of the present invention is shown therein and indicated generally by the numeral 10.

Viewing boat support system 10 in detail, it is seen that the same includes a rectangular base frame structure, indicated generally by the numeral 12, that is preferably constructed of steel. Frame structure 12 includes a pair of laterally spaced longitudinal members 14 and 16. Welded or secured by other suitable means transversely between and generally underneath the rspective longitudinal members 14 and 16 are a series of transverse frame members 18, 19, 20, 21 and 22.

FIG. 1 illustrates the transverse saddle type boat support system 10 in an erect posture where the same is adapted to support a boat. As seen in FIG. 1, the boat support system of the present invention includes a vertical support frame assembly, indicated generally by the numeral 24, secured about each end of base frame structure 12. Viewing each vertical support frame assembly 24, it is seen that the same includes a pair of elongated side members 26 and 28 that are secured to the base frame structure 12. In particular, elongated side members 26 and 28 are pivotably mounted to end portions of the longitudinal members 14 and 16 by pivot pins or other suitable pivot connecting means. As will be discussed subsequently herein, this enables the entire vertical support frame assembly 24 to be folded down within or adjacent to the base frame structure 12.

Continuing to refer to the vertical support frame assembly 24, it is seen that the same further includes a horizontal reinforcing member 30 connected between the elongated side members 26 and 28. This gives rigidity to the vertical support frame assemblies 24.

Secured between the upper portions of the respective elongated side members 26 and 28 is a hull support panel 32 that is constructed of plywood or other suitable material. Hull support panel 32 is detachably mounted within elongated side members 26 and 28. There is provided a selectively shaped and curved upper edge **32*a* that is preferably padded with a carpet-like material. A resilient type material or some other suitable material to prevent damage, scratching or scarring the supported boat hull. It should be emphasized at this point that the upper supporting edge 32*a* can be particularly designed, shaped and curved to fit a particular size and shape of hull. It is appreciated that the boat support system 10 of the present invention could be provided with a variety of hull support panels 32 with each set being particularly shaped and contoured to fit a particular type and size of boat hull. This obviously gives the boat support system 10 of the present invention substantial utility inasmuch as it allows the same to accommodate and be compatible with a wide range of boat hull sizes and shapes. It is seen from viewing FIG. 1 that hull support panel 32 can be easily and quickly detached from the respective elongated side members 26 and 28 by simply disconnecting the bolts that serve to attach the hull support panel 32 to the elongated side members 26 and 28**.

To reinforce the vertical support frame assemblies 24, each frame assembly is provided with a pair of diagonal braces 34 and 36. From the drawings, it is seen that the diagonal braces 34 and 36 extend from an upper portion of elongated side members 26 and 28 downwardly to where they connect to the longitudinal members 12 and 14 of the base frame structure 12.

Figure 2:
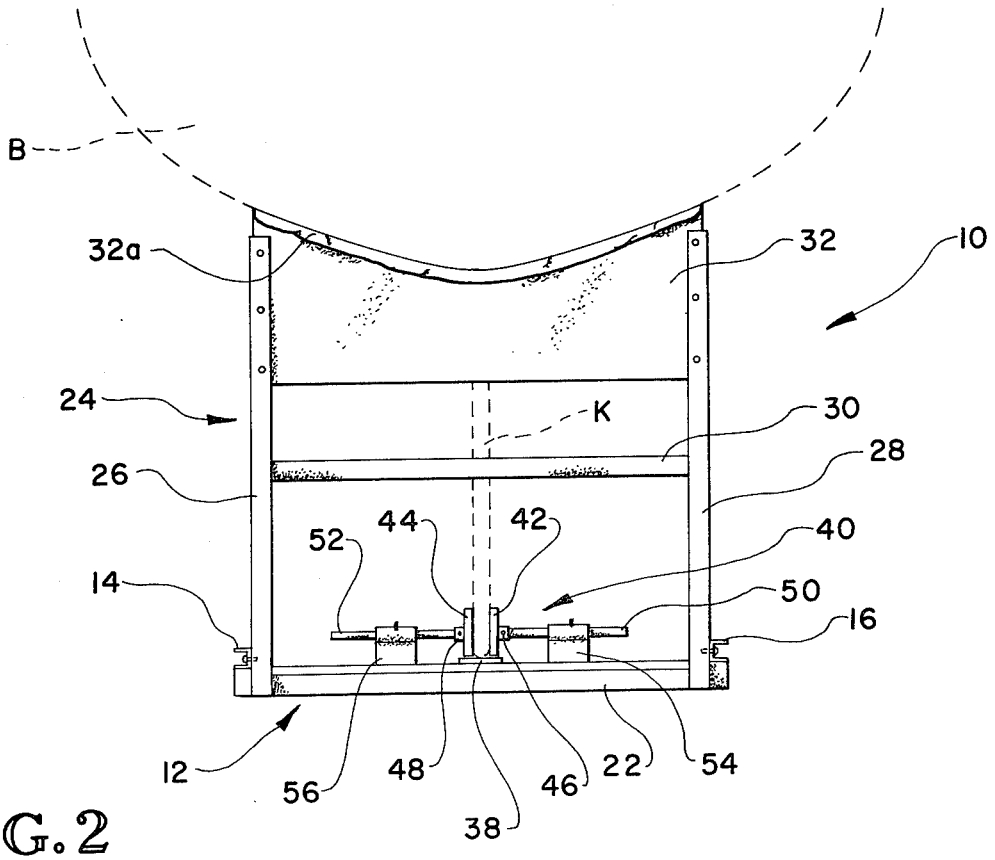
FIG. 2 is a front elevational view of the boat support system shown in FIG. 1.

To support the boat keel K, as illustrated in dotted lines in FIG. 2, there is provided a keel support board 38 that is supported by base frame structure 12 that generally lies or is positioned longitudinally across a series of transverse frame members 19, 20 and 21.

To prevent a supported boat, indicated by B in FIG. 2, from rotating within the saddle type cradle formed by the hull support panels 32, the boat support system 10 of the present invention is provided with keel restraining means, indicated generally by the numeral 40. With particular reference to FIG. 2, it is seen that the keel restraining means includes a pair of padded keel restraining panels 42 and 44. Restraining panels 42 and 44 are preferably disposed in spaced apart relationship so as to define an opening therebetween for receiving the boat keel K.

Restraining panels 42 and 44 are connected to a pair of support shafts 50 and 52 by universal couplers 46 and 48 that allow the panels 42 and 44 to pivot in order to appropriately conform to the outer surface of the boat keel K when a boat is supported by the system of the present invention. As seen in FIG. 2, the support shafts 50 and 52 are confined within a shaft support and holding structure 54 and 56 that extend up from the base frame structure. Each shaft support and holding device 54 and 56 is provided with a transverse opening therein for receiving the respective shafts 50 and 52. In addition, there is provided a set screw for appropriately securing the respective shafts 50 and 52 in a stabilized position where the respective restraining panels 42 and 44 lie on opposite sides of the boat keel K so as to restrain the same from moving laterally to one side.

In operation it is appreciated that a boat B can be disposed over the respective hull support panels 32. It is appreciated that in this posture the boat B is supported fore-and-aftly above the base frame structure 12. In addition the keel restraining means 40 prevents the keel K from moving side to side.

It is further appreciated that the hull support panels 32 can be quickly and easily removed and replaced by other hull support panels that will appropriately fit a boat to be supported. This gives the boat support system 10 of the present invention a great deal of utility inasmuch as the same can support boat hulls of various sizes and shapes.

Finally, to easily and conveniently transport and/or store the boat support system 10 of the present invention, it is appreciated that the diagonal braces 34 and 36 can be removed and the entire vertical support frame assembly 24 pivoted downwardly and inwardly onto the base frame structure 12. This obviously reduces the height of the support system 10 and enables a quantity of such systems to be stacked one over the other for transport and/or storage.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A fore-and-aft transverse saddle type boat cradle for supporting a boat, wherein said boat cradle is capable of assuming a collapsed, folded down position in order that respective boat cradle can be stacked one on top of another for economical and practical transport, comprising:

A. a base frame structure including a generally rectangular frame having two laterally spaced apart longitudinally extending frame members and a plurality of transverse frame members operatively interconnected between said longitudinal frame members;

B. fore-and-aft vertical support frame assemblies secured to said base frame structure and in an operative boat supporting mode extend upwardly for transversely engaging and supporting a boat at fore-and-aft areas, each of said fore-and-aft vertical support frame assemblies including:

1. means movably mounting said vertical support frame assembly to said base frame structure for movement from a vertical support position inwardly toward said base structure to a generally horizontal folded position overlying said base structure, and visa versa, wherein in said generally horizontal folded position said support frame assembly lies adjacent said base frame structure such that a plurality of cradles may be stacked one over the other for transport;

2. a transverse hull support panel that extends substantially across said vertical support frame assembly and includes an upper support surface selectively shaped and curved to generally comform to the shape of a boat hull to be supported;

C. diagonal brace means connected between said vertical support frame assembly and said base frame structure for diagonally bracing said vertical support frame assemblies when the latter is positioned upright in a supporting mode of operation, said diagonal brace means including a pair of diagonal braces detachably connected between each vertical support frame assembly and said base frame structure; and D. keel restraining means mounted on at least one of said transverse frame members of said base frame structure for generally preventing the keel from moving laterally, thereby assuring that the boat being supported is supported in a generally upright posture said keel restraining means including a pair of laterally spaced restraining panels that normally and generally extend in vertical planes and which define therebetween a space for receiving the keel of a boat being supported whereby the presence of said panels about opposite sides of the keel tends to restrict the lateral movement of the keel.

2. The transverse saddle type boat cradle of claim 1 wherein said vertical support assemblies include detachable securing means for detachably securing the respective transverse hull support panels thereto such that various shape and configured transverse hull support panels may be selectively secured to said vertical support frame assemblies for supporting boats of different hull designs.

3. The transverse saddle type boat cradle of claim 1 wherein each vertical support frame assembly includes a pair of elongated laterally spaced members interconnected by a transverse member, and wherein said laterally spaced elongated members are adapted to detachably receive said transverse hull support panel.

4. The transverse saddle type boat cradle of claim 3 wherein said means for movably mounting said vertical support assemblies includes the provision of pivot means operatively interconnecting said laterally spaced elongated members of each vertical support frame assembly to said base frame structure.

5. The saddle type boat cradle of claim 1 wherein each keel restraining panel is secured to an elongated shaft and wherein there is provided adjustable holding means for receiving said elongated shaft such that the same can be adjustably positioned therein such that said keel restraining panels can be appropriately positioned with respect to the keel of the boat being supported.

6. The transverse saddle type boat cradle of claim 5 wherein the defined keel restraining means is supported by said base frame structure generally midway between opposite fore-and-aft ends.

7. The transverse saddle type boat cradle of claim 6 wherein said base frame structure includes a plurality of transverse frame members and wherein said keel restraining means is mounted to a selected transverse frame member extending generally midway between said vertical support frame assemblies when assuming an erect posture, and wherein said shaft holding means includes a transverse opening for receiving said shaft supporting said keel restraining panel and wherein said shaft holding means is provided with a set screw type adjustment for allowing the position of said shaft to be adjusted therein and securely held at a selected position.

8. The transverse saddle type boat cradle of claim 7 wherein there is provided pivot attaching means interconnecting said shaft with a respective keel restraining panel in order that said keel can pivot to and conform to an appropriate angle with respect to the adjacent keel.

9. The transverse saddle type boat cradle of claim 1 wherein selected members of said rectangular frame are disposed below other selected members in order to facilitate gripping and lifting of said boat cradle from the ground or other support surface.

* * * * *